US008403580B2

(12) United States Patent
De Laforcade

(10) Patent No.: US 8,403,580 B2
(45) Date of Patent: Mar. 26, 2013

(54) WRINGING-OUT MEMBER AND DEVICE COMPRISING SUCH A MEMBER

(75) Inventor: Vincent De Laforcade, Rambouillet (FR)

(73) Assignee: L'Oreal, Paris (FR)

( * ) Notice: Subject to any disclaimer, the term of this patent is extended or adjusted under 35 U.S.C. 154(b) by 724 days.

(21) Appl. No.: 12/516,219

(22) PCT Filed: Dec. 4, 2007

(86) PCT No.: PCT/EP2007/063318

§ 371 (c)(1), (2), (4) Date: Feb. 2, 2010

(87) PCT Pub. No.: WO2008/068271

PCT Pub. Date: Jun. 12, 2008

(65) Prior Publication Data

US 2010/0129133 A1 May 27, 2010

Related U.S. Application Data

(60) Provisional application No. 60/869,485, filed on Dec. 11, 2006.

(30) Foreign Application Priority Data

Dec. 5, 2006 (FR) ..... 06 55318

(51) Int. Cl.
*A46B 11/00* (2006.01)

(52) U.S. Cl. ..... 401/129; 401/122; 401/126

(58) Field of Classification Search ..... 401/9, 11, 401/12, 121, 122, 126, 129; 15/104.92, 160, 15/164, 104.04, 257.05, 263.03
See application file for complete search history.

(56) References Cited

U.S. PATENT DOCUMENTS

| | | | | |
|---|---|---|---|---|
| 1,728,712 | A * | 9/1929 | Aberle | 15/160 |
| 3,471,244 | A * | 10/1969 | Melocchi | 401/122 |
| 4,628,950 | A | 12/1986 | Bitzer | |
| 4,810,122 | A | 3/1989 | Cole | |
| 5,397,193 | A * | 3/1995 | Kirk et al. | 401/122 |
| 5,490,737 | A | 2/1996 | Gueret | |
| 5,722,436 | A * | 3/1998 | Vandromme et al. | 132/218 |
| 6,238,116 | B1 | 5/2001 | Smith et al. | |
| 6,502,584 | B1 | 1/2003 | Fordham | |
| 6,508,603 | B1 * | 1/2003 | Vasas | 401/129 |
| 6,983,508 | B2 * | 1/2006 | Saurer | 15/104.04 |
| 7,302,915 | B2 * | 12/2007 | Leary et al. | 119/664 |

FOREIGN PATENT DOCUMENTS

| | | |
|---|---|---|
| EP | 0 116 952 | 8/1984 |
| EP | 0 204 466 | 12/1986 |
| GB | 2 063 823 | 6/1981 |
| WO | 95 26147 | 10/1995 |

* cited by examiner

*Primary Examiner* — David Walczak
(74) *Attorney, Agent, or Firm* — Oblon, Spivak, McClelland, Maier & Neustadt, L.L.P.

(57) ABSTRACT

A wringing-out member configured to rid an applicator of the brush type of excess product, the said wringing-out member extending along a main axis of elongation and comprising an internal face provided with wringing-out elements, in which the said wringing-out elements comprise at least three protrusions, two protrusions between them defining a slot and a third protrusion anchored on the said internal face of the wringing-out member at a different axial height from the said two protrusions, the said third protrusion projecting at least partially opposite the said slot.

20 Claims, 3 Drawing Sheets

WRINGING-OUT MEMBER AND DEVICE COMPRISING SUCH A MEMBER

The present invention relates to a wringing-out member intended to rid an applicator of the brush type of excess cosmetic product, and to a device for packaging and applying such a cosmetic product comprising such a wringing-out member. The expression "cosmetic product" is to be understood to mean a product as defined in Council Directive 93/35/EEC of 14 Jun. 1993.

Favoured, although non-exclusive, applications of the present invention involve applying a cosmetic product to keratinous fibres, and in particular, applying mascara to eyelashes. In particular, the present invention is aimed at suitably wringing-out an applicator impregnated with mascara.

Numerous devices allow an applicator to be wrung out with a view to ridding the applicator of any surplus product and these are listed in the prior art.

Documents FR 1 511 770, U.S. Pat. No. 4,403,624, U.S. Pat. No. 4,628,950, U.S. Pat. No. 4,810,122, U.S. Pat. No. 5,349,972, U.S. Pat. No. 5,875,791 and WO 95/26147 disclose examples of devices of the prior art.

Document FR 1 511 770 in particular discloses a device for applying make-up to the eyes. This device comprises a paintbrush-style applicator of the eyeliner type. This device comprises a bottle housing a number of wringing-out members. These wringing-out members rid the applicator of any excess product.

However, a disadvantage associated with this type of device is that it involves numerous components for wringing out the applicator. A wringing-out member such as this therefore proves to be particularly difficult to manufacture and to assemble.

Document WO 95/26147 discloses a device comprising an applicator of the brush type. This device comprises a wringing-out member having a free end in the form of radial projections all extending in one and the same plane.

However, one disadvantage associated with this wringing-out member is that the applicator is wrung out somewhat ineffectively. This is because the user has to orientate the applicator appropriately in order sufficiently to wring out the bristles of the applicator.

It is therefore an object of the present invention to overcome at least one of the aforementioned disadvantages.

It is a particular object of the present invention to provide a wringing-out member that is easy to manufacture, to assemble and which effectively wrings out the applicator.

It is another object of the present invention to provide a wringing-out member able effectively to wring out an applicator of the brush type, irrespective of the configuration of the bristles or teeth and regardless of the orientation of the applicator as it is withdrawn from the container.

Yet another object of the present invention is to provide a wringing-out member of low cost price.

A subject of the present invention is therefore a wringing-out member intended to rid an applicator of the brush type of excess product, the said wringing-out member extending along a main axis of elongation and comprising an internal face provided with wringing-out elements, in which the said wringing-out elements comprise at least three protrusions, two protrusions between them defining a slot and a third protrusion anchored on the said internal face of the wringing-out member at a different axial height from the said two protrusions, the said third protrusion projecting at least partially opposite the said slot.

This number of protrusions which are both axially offset along the main axis of elongation of the wringing-out member and angularly offset about this axis allows the applicator to be wrung out effectively. In particular, such protrusions save the user from having to orientate the applicator accurately when extracting it from the device.

The expression "slot" should be understood to mean any type of passage of any configuration suited to having an applicator moved through it.

The said protrusions may extend radially in different planes secant to the main axis of elongation.

Each plane may be defined by at least two protrusions. These protrusions preferably define a uniform circumferential gap between them so that the applicator can be wrung out effectively regardless of the angular orientation of the applicator relative to the wringing-out member.

The said protrusions may extend from a respective generatrix of the wringing-out member, at least some protrusions of one plane being able to extend from different generatrices from the generatrices from which the protrusions of another plane extend.

The said different planes may be mutually parallel.

The said different planes may be perpendicular to the main axis of elongation.

The said different planes may be spaced equal distances apart. These planes may equally be spaced different distances apart.

The said protrusions of one and the same plane may be of similar lengths.

The said protrusions of two different planes may be of different respective lengths. For the same thickness or diameter, a feature such as this makes it possible to vary the degree of flexibility of the different protrusions. Thus, a feature such as this makes it possible to create several wringing-out levels of different intensities. The protrusions of two different planes may also have similar respective lengths so that the intensity of the wringing-out action is appreciably constant over part or all of the height of the wringing-out member.

The said protrusions may extend from a frustoconical portion of the wringing-out member. A portion such as this makes it possible, on the one hand, to provide better guidance for the applicator in the wringing-out member and, on the other hand, to perform more or less pronounced wringing-out of the applicator according to the height at which it is positioned in the wringing-out member.

The said protrusions may have a free end able to bear against the said applicator. Such free ends may thus form means of guiding the applicator as it is extracted from the device.

The said protrusions may be produced as one piece with the said wringing-out member.

Two adjacent protrusions extending in one and the same plane may define a circular sector with the cylinder axis, and the said circular sector, when considered from the cylinder axis, may cover an angle of between 10 and 45°.

The said protrusions may have a cylindrical shape chosen from a circular cylindrical shape, a conical shape or a frustoconical shape. These various three-dimensional shapes give the protrusions a certain degree of rigidity and ensure that the different protrusions rub firmly against the applicator.

Another subject of the present invention is a device for packaging and applying a product, comprising:

- a container intended to contain a product of cosmetic type, such as a mascara,
- a wringing-out member,
- an applicator, particularly of the brush type, mounted in the said wringing-out member.

The said applicator may comprise a product-application part comprising a brush produced by injection-moulding a plastic. In such a case, the arrangement of the protrusions provides both intense and uniform wringing-out of the teeth of which such a brush is made.

The said application part may comprise at least one row of teeth, this row of teeth possibly comprising teeth of different lengths.

The said at least one row of teeth may comprise a first tooth portion and a second tooth portion, the said first tooth portion possibly comprising teeth of increasing length and the said second tooth portion possibly comprising teeth of constant length.

The said brush may comprise two or more rows of teeth, each row of teeth being able to define an angle of between 20 and 45°, preferably of 30° with an adjacent row of teeth.

The said wringing-out member may comprise means of off-centering the said product-application part relative to the main axis of elongation X of the wringing-out member.

The said applicator may comprise a support wand, the said off-centering means possibly comprising a discontinuity in the form of a dogleg positioned between the said product-application part and the said support wand.

The said container may comprise a neck defining an opening in which the said wringing-out member is mounted.

The said wringing-out member may comprise a retaining means for holding it in the container.

The said retaining means may comprise a corolla projecting externally from the wringing-out member, the said corolla being able to nestle under a shoulder of the said container.

The invention may be better understood from reading the following detailed description, given with reference to the accompanying drawings which illustrate a non-limiting embodiment thereof and in which.

Figure 1:
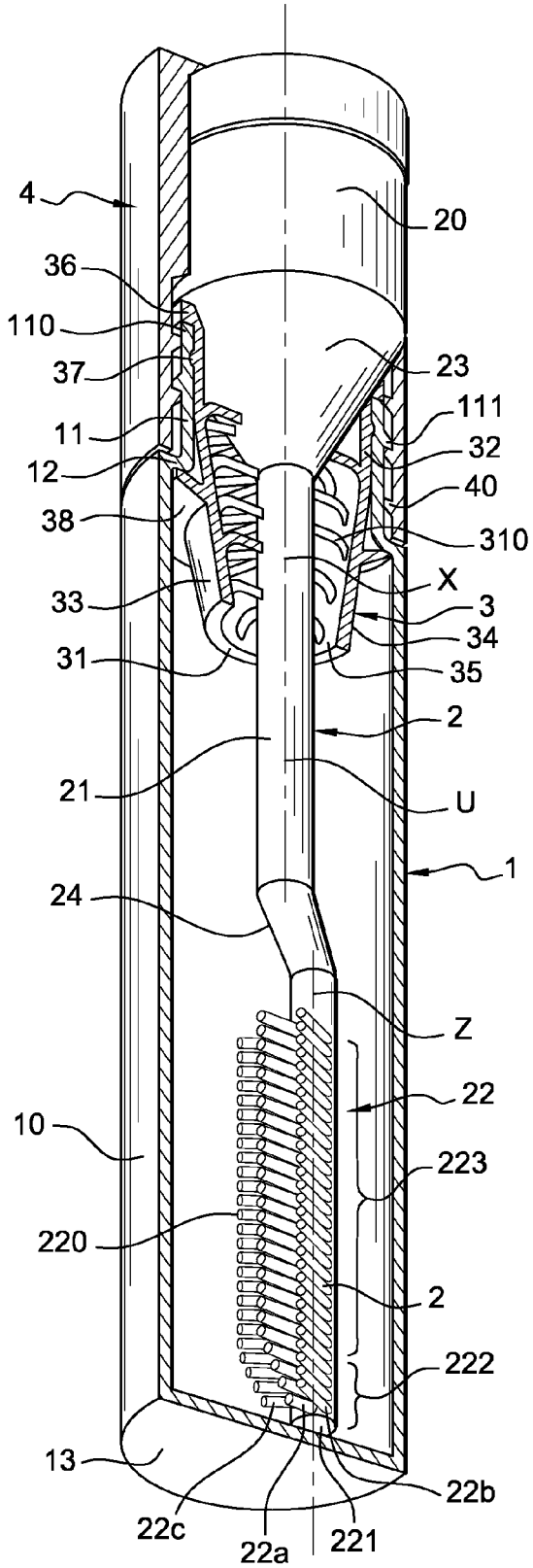
FIG. 1 is a partial schematic view in longitudinal section of one embodiment of a device according to the invention.
Figure 2:
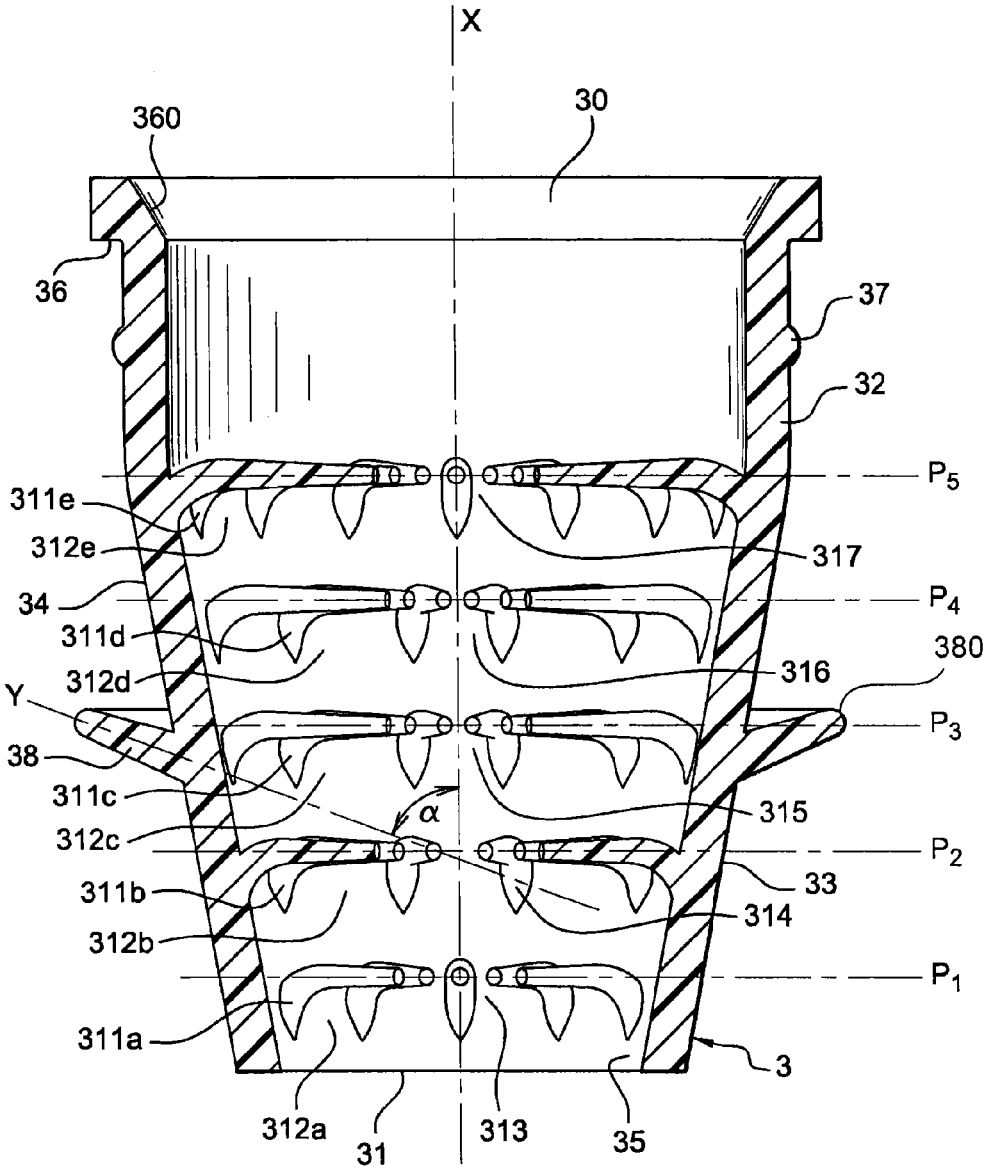
FIG. 2 is a schematic view in longitudinal section of part of the device according to the invention.

FIG. 1 depicts one exemplary embodiment of a packaging and application device according to the present invention. This device comprises a container 1, an applicator 2, a wringing-out member 3 and, optionally, a lid 4.

The container 1 comprises a body 10 comprising a part provided with a neck 11 and an opposite part closed off by a bottom 13. The body 10 in this example is in the shape of a cylinder of revolution. However, the said body could have any appropriate shape.

The neck 11 is connected to the body 10 by a shoulder 12. A neck such as this may have external screw threads 111.

This neck comprises a free edge 110 defining an opening through which the container can be filled with fluid product. The fluid product is a cosmetic product. This product may be a make-up product such as a mascara.

The applicator 2 comprises a member 20 for holding, a support wand 21 and a product-application part 22. This applicator is preferably produced in a single piece by injection-moulding of plastic. In this example, the applicator is in the form of a brush. However, this embodiment is non-limiting and any other type of applicator may be used, for example a paintbrush, a comb or a twisted brush.

The member 20 for holding may have a cylindrical shape on a circular base. This member for holding may be connected to the wand 21 by an intermediate portion 23 of frustoconical shape.

The wand 21 may be connected to the application part 22 by a discontinuity 24. This discontinuity may have the form of a dogleg. Thus, the wand 21 can extend along a main axis of elongation U and the discontinuity 24 may extend along a main axis of elongation Z. These two axes U and Z may be parallel to one another. The purpose of such a dogleg will be mentioned in a later part of the description.

The application part 22 supports teeth 220. These teeth extend in the form of rows. Each row of teeth may, for example, comprise between 10 and 35 teeth. In the example depicted in FIG. 1, this application part 22 comprises three rows of teeth. However, this application part 22 may comprise a lower or higher number of rows of teeth, such as 1, 2, 4 or 5 rows of teeth.

These rows of teeth are, in this example, arranged in a central row 22*a*, flanked on each side by a lateral row 22*b* and 22*c* respectively. The teeth that make up the central row 22*a* may stand up orthogonally from the application part 22.

Figure 4:
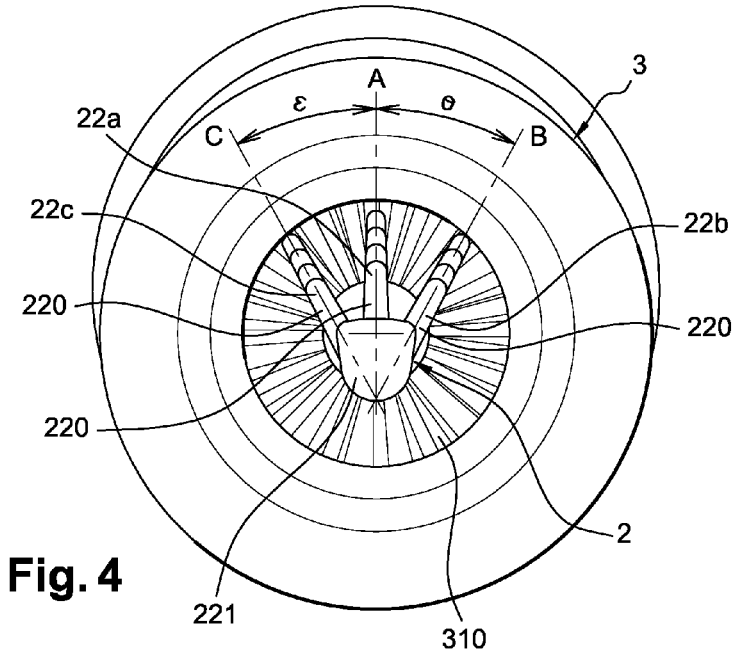
FIG. 4 is a schematic perspective view from below for that part of the device depicted in FIG. 3, comprising another part of the device mounted inside it.

As can be seen in FIG. 4, this central row 22*a* and these lateral rows 22*b*, 22*c* extend in three separate planes of elongation A, B and C, respectively.

The plane A may define angles $\theta$ and $\epsilon$ of between 20 and 45°, more preferably between 25 and 35°, and preferably of about 30° with the planes B and C respectively. The plane A may intersect at its middle the angle formed between the planes B and C. This plane A may also define a plane of symmetry of the application part 22.

The application part 22 comprises a free end 221. Each row of teeth may have a first tooth portion 222 and a second tooth portion 223. The first tooth portion 222 is situated near the free end 221 of the application part. This first tooth portion may comprise teeth the lengths of which increase from the free end 221. The second tooth portion 223 may, for its part, comprise teeth of constant length.

The wringing-out member 3 internally defines a passage open at two opposite ends 30, 31. This wringing-out member has a main axis of elongation X. In this exemplary embodiment, this wringing-out member comprises a circular cylindrical part 32 and a frustoconical part 33. The said wringing-out member comprises an external face 34 and an internal face 35.

A flange 36 stands out radially from the circular cylindrical part 32. This flange may internally have a countersunk edge 360.

The circular cylindrical part 32 may also have a bulge 37 projecting from the external face 34.

The frustoconical part 33 may comprise a corolla 38 provided with a free edge 380. This corolla extends laterally from the external face 34. A corolla such as this has a longitudinal axis Y which may, with the main axis of elongation X of the wringing-out member, make an angle $\alpha$ for example of between 60 and 80°.

The internal face 35 of the wringing-out member comprises a plurality of wringing-out elements 310. According to one advantageous embodiment, these wringing-out elements extend from the frustoconical part 33 of the wringing-out member. These wringing-out elements comprise protrusions or tabs 311*a*, 311*b*, 311*c*, 311*d* and 311*e*. These protrusions may be discretely distributed. In other words, these protrusions may be provided at distances apart. Each protrusion may extend radially towards the inside of the wringing-out member 3. These protrusions may be orientated towards the main axis of elongation X of the wringing-out member. Such protrusions may extend obliquely or at right angles to the said main axis of elongation X.

The protrusions 311*a*, 311*b*, 311*c*, 311*d* and 311*e* between them define respective slots or passages 312*a*, 312*b*, 312*c*,

312*d* and 312*e*. These protrusions 311*a*, 311*b*, 311*c*, 311*d* and 311*e* comprise an anchor point 3110*a*, 3110*b*, 3110*c*, 3110*d* and 3110*e* respectively anchoring them to the internal face 35 and a free end 3111*a*, 3111*b*, 3111*c*, 3111*d* and 3111*e* respectively.

The said protrusions may have a circular cylindrical, frustoconical, conical, parallelepipedal, flattened, oval or some other shape.

According to the invention, the said wringing-out member comprises at least three protrusions, two protrusions, for example 311*a*, between them defining a slot 312*a*, and a third protrusion, for example 311*b*, has an anchor point 3111*b* on the internal face 35 of the wringing-out member 3 which anchor point is situated at a different axial height from the respective anchor points 3110*a* of the other two protrusions, the said third protrusion at least partially projecting opposite the said slot.

The protrusions 311*a*, 311*b*, 311*c*, 311*d* and 311*e* and/or the anchor points 3110*a*, 3110*b*, 3110*c*, 3110*d* and 3110*e* of the protrusions may extend in planes P1, P2, P3, P4 and P5 respectively. These planes extend at different axial heights of the wringing-out member. Such planes are secant to the main axis of elongation X of the wringing-out member 3. In particular, these planes may extend at right angles to the said main axis of elongation X. These planes may be mutually parallel or mutually secant. According to one particular embodiment, these planes may extend equal distances apart. Of course, it is possible for the protrusions to define a lower or higher number of planes.

Each plane may be defined by a plurality of protrusions. In particular, each plane may be defined by at least two protrusions. For the plane P5 may be defined by 16 protrusions 311*e*, the plane P4 by 12 protrusions 311*d*, the plane P3 by 10 protrusions, the plane P2 by 8 protrusions and the plane P1 by 6 protrusions.

The protrusions may in cross section have a dimension, particularly a diameter, of between 0.25 and 2 mm, and more specifically of between 0.5 and 1 mm. At their anchor point, the protrusions may for example have a diameter of about 1 mm. At their free ends, these protrusions may for example have a diameter of about 0.5 mm.

The protrusions 311*a*, 311*b*, 311*c*, 311*d*, 311*e* extend from a respective generatrix of the wringing-out member 3, at least some protrusions of one plane P1, P2, P3, P4, P5 extending from different generatrices from the generatrices from which the protrusions of another plane extend.

Figure 3:
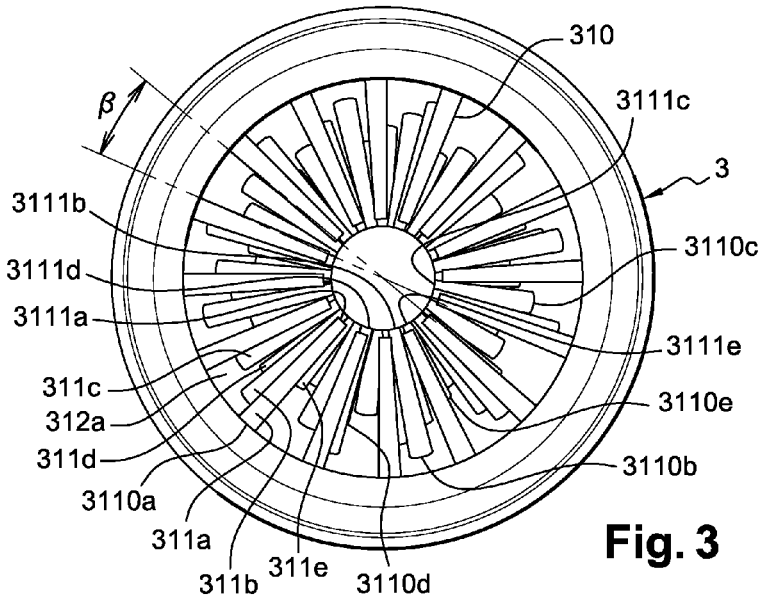
FIG. 3 is a schematic perspective view from above of part of the device according to the invention.

As can be seen in FIG. 3, several protrusions belonging to one or more different planes may extend opposite one and the same slot situated in another plane.

The slots 312*a*, 312*b*, 312*c*, 312*d* and 312*e* may have the shape of a portion of a disc. In other words, two adjacent protrusions in the same plane, for example lying in the plane P1, may between them define a circular sector. This circular sector when considered from the main axis of elongation X of the wringing-out member may cover an angle β of, for example, between 10 and 45° and more preferably of between 15 and 35°.

A cross section through the wringing-out member has a circular shape in the example depicted. When considering a cross section such as this taken at a plane chosen from the planes P1, P2, P3, P4 or P5, the corresponding protrusions may extend over a distance equivalent to over half the radius of this cross section. As a preference, these protrusions extend over a distance of between 60% an 75% of the radius of the said cross section.

The protrusions situated in one and the same plane are preferably of substantially equal lengths. As can be seen in the figures, the protrusions in plane P1 may be shorter than the protrusions in plane P2, the protrusions in plane P2 may be shorter than the protrusions in plane P3, and so on. However, because the protrusions are provided on the frustoconical part 33 of the wringing-out member, the free ends 3111*a*, 3111*b*, 3111*c*, 3111*d* and 3111*e* of the protrusions from the different planes may lie at substantially identical distances from the main axis of elongation X of the wringing-out member 3.

The free ends 3111*a*, 3111*b*, 3111*c*, 3111*d* and 3111*e* of the protrusions 311*a*, 311*b*, 311*c*, 311*d* and 311*e* respectively, when projected onto a projection plane orthogonal to the main axis of elongation X, may together define a circle with a broken or discontinuous edge. This circle internally defines an orifice 313, 314, 315, 316 and 317 respectively, of a diameter substantially equal to, smaller than or greater than the diameter of the wand 21 of the applicator. These orifices may all lie on the main axis of elongation X of the wringing-out member 3. As can be deduced from FIGS. 3 and 4, the free ends of the protrusions in the various planes, when projected onto a projection plane orthogonal to the main axis of elongation X, may all together define a circle with a continuous edge.

According to one advantageous embodiment, a wringing-out member such as this may be produced as one piece by injection-moulding of plastic. This wringing-out member may for example be produced from one or more thermoplastic elastomers such as ethylene propylene diene monomer (EPDM), santoprene, hytrel, butadiene, neoprene, nitrile or butyl rubbers, injectable silicones, very low density polyethylenes or alternatively, polyurethanes.

The protrusions may have a hardness ranging between 30 and 90 Shore A, more specifically between 50 and 70 Shore A and in particular of approximately 60 Shore A. As will be explained in greater detail in a later part of this description, the protrusions may be configured in such a way as to exhibit variable flexibility along the main axis of elongation of the wringing-out member. A difference such as this may thus create a wringing-out of the applicator of varying intensity as it is moved through the wringing-out member. This difference in the intensity of the wringing-out action may in particular be associated with differences in configuration of the protrusions, particularly in terms of their overall shape, or may stem from a difference in their size, particularly their length or their diameter.

The wringing-out member 3 is intended to be associated with the container 1. To do this, this wringing-out member is mounted in the opening of the neck 11 of the container. Upon mounting, the corolla 38 flexes inwards. In other words, this corolla folds inwards in the direction of a reduction in the magnitude of the angle α. Once the corolla 38 has negotiated the neck 11, this corolla, which has shape memory, reverts to its initial configuration. This corolla therefore positions itself at least partially under the shoulder 12 of the container. A corolla such as this constitutes a retaining means for holding the wringing-out member in the container. Thus, it allows the wringing-out member to be secured, preferably permanently, to the container.

Provision may be made for the free edge 380 of this corolla to come to bear in a sealed manner against the said shoulder 12.

Furthermore, in the final mounted position, the radial flange 36 may butt against the free edge 110 of the neck of the container. The bulge 37 for its part may be positioned in sealing close contact with the neck 11. These various collaborations play a part in sealing the region stretching between the external face 34 of the wringing-out member and the said neck 11.

Once the wringing-out member has been mounted, the applicator 2 can be placed in the container 1 in contact with the fluid product. To do this, the application part 22 and part of the wand 21 are introduced through the wringing-out member 3. In the final mounted position, the intermediate part 23 of the applicator comes to bear against the countersunk edge 360 of the wringing-out member. Collaboration such as this is aimed at sealing the area stretching between the applicator 2 and the wringing-out member 3. Furthermore, the free ends 3111*a*, 3111*b*, 3111*c*, 3111*d* and 3111*e* of the wringing-out elements 310 may bear against the said applicator 2, and particularly against the wand 21 and the intermediate part 23. These wringing-out elements 310 are thus able to establish rubbing contact with the said applicator. Such wringing-out elements thus allow the applicator 2 to be guided and kept stably in the mounted position inside the container. In this mounted position, the said main axis of elongation U of the wand 21 of the applicator may coincide with the said main axis of elongation X of the wringing-out member 3.

It should be noted that the application member 2 could equally be associated with the wringing-out member 3 prior to being mounted on the container 1.

Once the applicator 2 has been mounted, a lid 4 may be provided. A lid such as this overhangs the container. The lid may be screwed onto the container. To do this, the internal screw threads 40 of the lid may collaborate with the external screw threads 111 of the neck of the container 1. In the final mounted position, the lid may butt against the shoulder 12 of the container. Of course, the lid could be fixed onto the container by other appropriate means of attachment, such as clip-fastening.

Moreover, it is possible to provide an applicator and a lid made in one piece. In this case, the member via which the applicator 2 is held may be the lid.

When the user wishes to apply make-up, she removes the lid 4, takes hold of the applicator 2 at the member 20 for holding and pulls on the said applicator in order to extract it from the container 1.

It should be noted that the discontinuity 24 of the applicator 2 may allow the applicator 2 to be off-centered with respect to the main axis of elongation X of the wringing-out member 3. In the exemplary embodiment depicted in FIG. 1, the container body 10 has a main axis of elongation that more or less coincides with the said main axis of elongation X of the wringing-out member. Thus, this discontinuity 24 may offset the application part 22 both from the axis of elongation of the wringing-out member and from the axis of elongation of the body of the container.

According to an alternative form which has not been depicted, if the teeth 220 of the application part 22 extend on an opposite face of the application part, that is to say are orientated in such a way that they lie at 180° with respect to the teeth depicted in FIG. 1, the discontinuity 24 may allow the said teeth of the applicator to bear against the body of the container 10. This application part 22 can therefore be moved in frictional contact against the body of the container as it is withdrawn from the container. This friction may occur until the discontinuity 24 of the applicator comes into contact with the wringing-out elements 310. The wringing-out elements 310 then encounter the application part 22 in the main axis of elongation of the wringing-out member. A discontinuity such as this may thus serve to perform an initial wringing-out of the applicator 2.

Next, as can be seen in FIG. 4, the application part 22 and, in particular, the teeth 220 butt against the wringing-out elements 310. These wringing-out elements, because of their configuration and the way in which they are arranged in the said wringing-out member 3, thus force the teeth 220 to rub against them, and to do so irrespective of the orientation of the applicator 22 as it is withdrawn from the container. The protrusions intensely wring out each of the teeth that make up the application part. An embodiment such as this is particularly, although not exclusively, suitable for an applicator of the brush type as depicted.

As seen earlier, the protrusions may be provided on a frustoconical part of the wringing-out member and be of lengths that increase from the plane P1 to the plane P5. These protrusions thus have a length that increases in the direction in which the said frustoconical part widens. The smaller the protrusions, the less able they will be to flex. Thus, the protrusions of the plane P1 are not as flexible as the protrusions of the plane P5 for example. Configuring the wringing-out member in this way therefore makes it possible to obtain a graduated structure in which the application part is wrung out to different extents according to the height at which the applicator lies in the said wringing-out member.

Throughout the description, the expression "comprising a" is to be understood as being synonymous with "comprising at least one", unless specified otherwise.

The invention claimed is:

1. A wringing-out member configured to rid an applicator of a brush type of excess product, the wringing-out member extending along a main axis of elongation, the wringing-out member comprising:

wringing-out elements projecting outwardly from an internal face of the wringing-out member, wherein the said wringing-out elements comprise at least three protrusions, two of the protrusions defining a slot and provided on a first plane secant to the main axis of elongation, and a third protrusion anchored on the internal face of the wringing-out member provided on a second plane secant to the main axis at a different axial height from the first plane, the third protrusion projecting at least partially opposite the slot, wherein the wringing-out member includes a frustoconical portion extending along the main axis and the protrusions on each of the planes extend from the frustoconical portion, and wherein the protrusions of the different planes have different lengths.

2. The wringing-out member according to claim 1, wherein each plane is defined by at least two protrusions.

3. The wringing-out member according to claim 1, wherein the protrusions extend from a respective generatrix of the wringing-out member, at least some protrusions of one plane extending from different generatrices from which protrusions of another plane extend.

4. The wringing-out member according to claim 1, wherein the planes are mutually parallel.

5. The wringing-out member according to claim 1, wherein the planes are perpendicular to the main axis of elongation.

6. The wringing-out member according to claim 1, wherein the planes are equally spaced.

7. The wringing-out member according to claim 1, wherein each of the protrusions has a free end configured to bear against the applicator.

8. The wringing-out member according to claim 1, wherein the protrusions are produced as one piece with the said wringing-out member.

9. The wringing-out member according to claim 1, wherein two adjacent protrusions extending in one of the planes define a circular sector with the main axis of elongation, and the circular sector, when considered from the main axis of elongation, covers an angle β of between 10 and 45°.

10. The wringing-out member according to claim 1, wherein the protrusions have a cylindrical shape chosen from a circular cylindrical, conical or frustoconical shape.

11. A device for packaging and applying a product, the device comprising:

a container configured to contain a cosmetic product, the wringing-out member according to claim 1, and an applicator mounted in the wringing-out member.

12. The device according to claim 11, wherein the applicator comprises a product-application part comprising a brush produced by injection-moulding a plastic.

13. The device according to claim 12, wherein the applicator comprises means of off-centering the product-application part relative to the main axis of elongation of the wringing-out member.

14. The device according to claim 13, wherein the applicator comprises a support wand, and the off-centering means comprises a discontinuity in a form of a dogleg positioned between the product-application part and the support wand.

15. The device according to claim 12, wherein the product-application part comprises at least one row of teeth, the row of teeth comprising teeth of different lengths.

16. The device according to claim 15, wherein the at least one row of teeth comprises a first tooth portion and a second tooth portion, the first tooth portion comprising teeth of increasing length and the said second tooth portion comprising teeth of constant length.

17. The device according to claim 11, wherein the applicator comprises two or more rows of teeth, each row of teeth configured to define an angle of between 20 and 45° with an adjacent row of teeth.

18. The device according to claim 11, wherein the container comprises a neck defining an opening in which the wringing-out member is mounted.

19. The device according to claim 11, wherein the wringing-out member comprises a retaining means for holding the wringing-out member in the container.

20. The device according to claim 19, wherein the retaining means comprises a corolla projecting externally from the wringing-out member, the corolla configured to nestle under a shoulder of the container.

* * * * *